United States Patent [19]

Kondo

[11] 4,373,415

[45] Feb. 15, 1983

[54] ELECTRONIC MUSICAL INSTRUMENT

[75] Inventor: Nobuaki Kondo, Omiya, Japan

[73] Assignee: Kabushiki Kaisha Kawai Gakki Seisakusho, Japan

[21] Appl. No.: 130,774

[22] Filed: Mar. 17, 1980

[30] Foreign Application Priority Data

Mar. 26, 1979 [JP] Japan ..... 54-35248

[51] Int. Cl.[3] ..... G10H 1/36

[52] U.S. Cl. ..... 84/1.01; 84/1.03; 84/DIG. 2; 84/DIG. 20; 84/DIG. 22

[58] Field of Search ..... 84/1.01, 1.03, 1.24, 84/DIG. 2, DIG. 12, DIG. 20, DIG. 22, DIG. 23

[56] References Cited

U.S. PATENT DOCUMENTS 3,712,950 1/1973 Freeman ..... 84/1.03

4,122,744 10/1978 Uetrecht ..... 84/1.24 X 4,162,644 7/1979 Sakashita ..... 84/1.03

4,232,581 11/1980 Uchiyama ..... 84/1.03

*Primary Examiner*—Stanley J. Witkowski

*Attorney, Agent, or Firm*—McGlew and Tuttle

[57] ABSTRACT

An electronic musical instrument in which a single manual keyboard is provided with two voicing blocks which has a certain keyboard space interval therebetween and at least one of which generates a multiple tone corresponding to keys being depressed. There is provided a circuit for providing a certain time interval from a time-divided signal produced by the key depression. This circuit distinguishes between tones from the two voicing blocks, to thereby separate them from each other. There is also a circuit for generating a monophonic or polyphonic tone signal from each of the separated time-divided signals.

5 Claims, 13 Drawing Figures

PRIOR ART
FIG. 1A
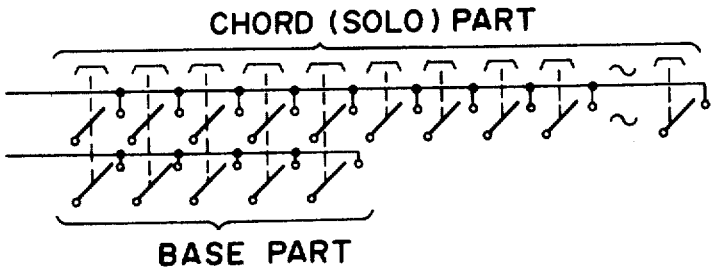
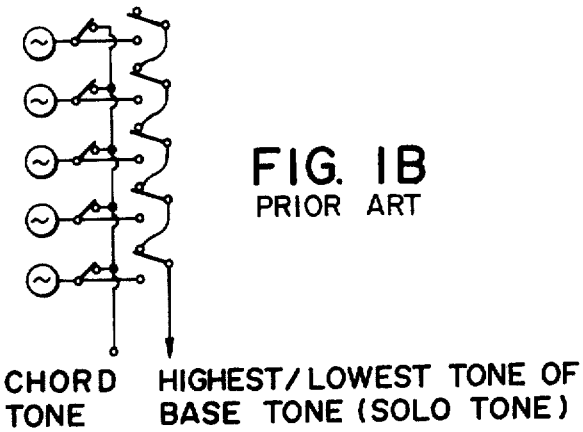
FIG. 1B
PRIOR ART
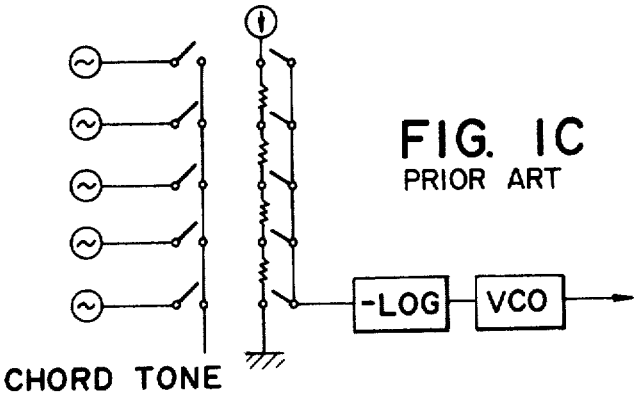
FIG. 1C
PRIOR ART

ELECTRONIC MUSICAL INSTRUMENT

BACKGROUND OF THE INVENTION

1. Field of the Invention

This invention relates to an electronic musical instrument in which there are provided in a single manual keyboard two voicing blocks which have a certain keyboard space interval therebetween and at least one of which generates a multiple tone corresponding to keys being depressed, whereby it is possible to perform, with the single manual keyboard alone, results which are similar to that produce using a plurality of keyboards. By voicing blocks it is meant a block for generating tone signals such as that of the melody, chord, or base. Generally, these are respectively provided by separate independent upper, lower and pedal keyboards.

2. Description of the Prior Art

In the past, in order to play solo (melody), chord (accompaniment) and base (low-frequency range) tones, it has been necessary to use keyboards which were each independent voicing blocks, that is, upper, lower and pedal keyboards. In order that the keyboards may be partly used in common, use has been made of such methods as shown in FIGS. 1A, 1B and 1C. In FIG. 1A, the chord or solo part of one keyboard is fixedly interlocked with the base part at the positions of certain keys. With this method, however, the frequency range of the base tone is limited. In FIG. 1B, chord tones are outputted by depression of keys in parallel from tone sources respectively connected to the keys, and as the base or solo tone, the highest or lowest tone is derived from each tone source. This method has the defect that whenever the key is depressed, the highest and lowest tones are detected and the base and solo tones are produced concurrently with the chord tone. In the case of a synthesizer, as shown in FIG. 1C, the chord tones are similarly outputted in parallel by depression of keys, but the base tone (accampaniment) is produced by obtaining the highest or lowest pitch determining voltage by depressing a tap of a frequency divider connected to a constant-current source and applying it via an anti-log (−log) circuit to a voltage-controlled oscillator. In this case, the keyboards cannot be used in common.

SUMMARY OF THE INVENTION

This invention is to provide an electronic musical instrument with which, using a single manual keyboard along it is possible to perform, results similar to that using a plurality of keyboards such as upper, lower and pedal keyboards.

To achieve the above object, in the electronic musical instrument of this invention, a single manual keyboard is provided with two voicing blocks which have a certain keyboard space interval therebetween and at least one of which generates a multiple tone corresponding to the keys being depressed. There is provided a circuit for producing, a certain time interval from a time-divided signal produced by key depression, this circuit distinguishes between tones from the two voicing blocks, to thereby separate them from each other. A circuit is also provided for generating a monophonic or polyphonic tone signal from each of the separated time-divided signal.

BRIEF DESCRIPTION OF THE DRAWINGS

FIGS. 1A, 1B and 1C are explanatory of prior art keyboard arrangements;

DESCRIPTION OF THE PREFERRED EMBODIMENTS

Figure 2:
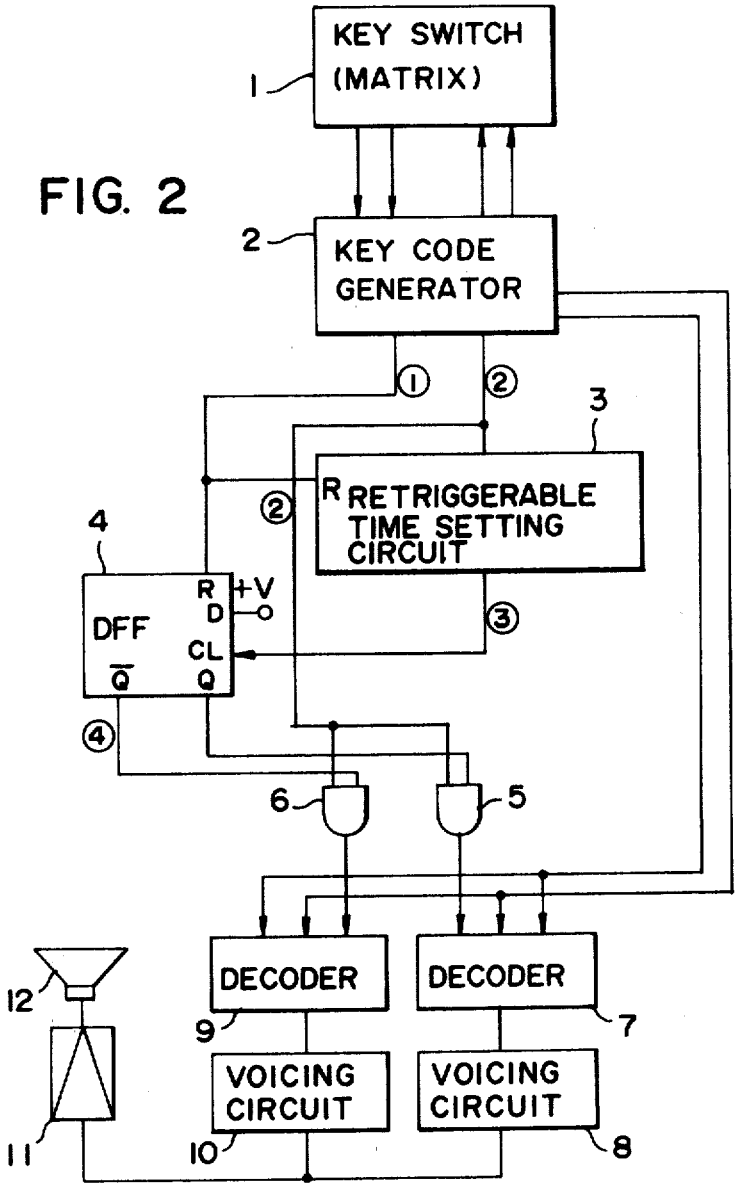
FIG. 2 is a block diagram illustrating an embodiment of the present invention.
Figure 3A:
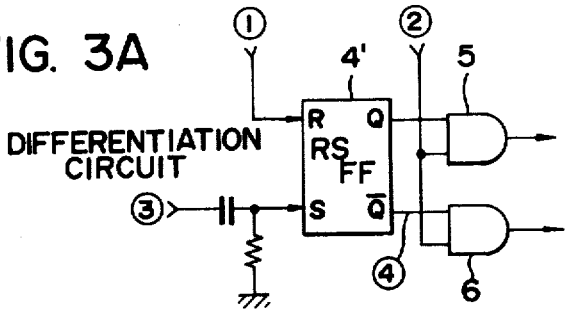
FIG. 3A shows a modified form of the embodiment of FIG. 2 which employs an RS flip-flop in place of the D flip-flop in FIG. 2.
Figure 3B:
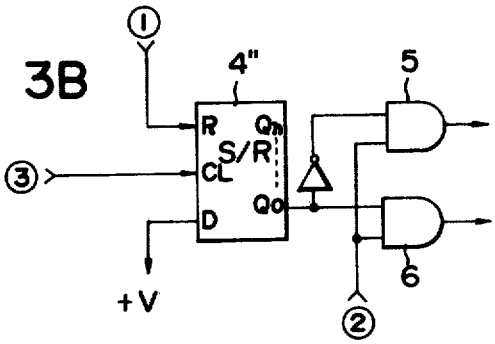
FIG. 3B shows another modified form of the embodiment of FIG. 2 which employs a shift register in place of the D flip-flop in FIG. 2.

FIGS. 2 and 3A and 3B are explanatory of the outline of the present invention, and FIGS. 4*a* to 4*d* are waveform diagrams explanatory of the operation of the embodiment of FIG. 2.

Figure 4:
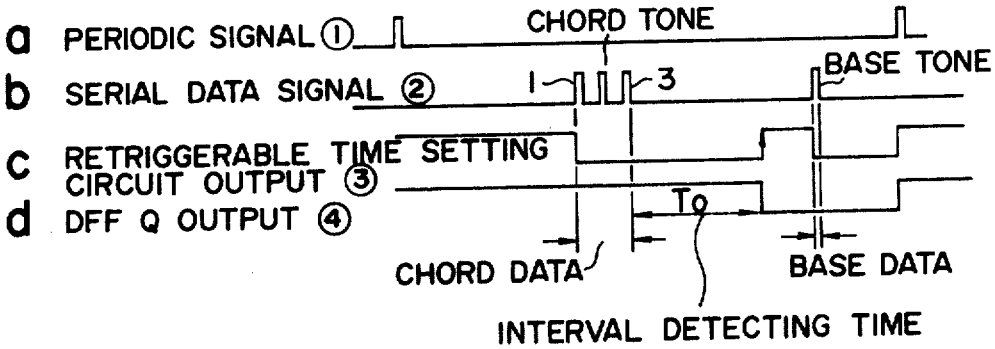
FIG. 4 shows operating waveforms useful in explaining the operation of FIG. 2.

In FIG. 2, a key switch 1 is a single manual keyboard with sixty-one keys, which is formed by a diode matrix comprising (8×8) diodes and on which are provided two voicing blocks having a certain keyboard space interval of one to two octaves therebetween. At least one of the voicing blocks generates a multiple tone and includes, for example, a chord and a solo part. A key depression signal from the key switch 1 is applied to a key code generator 2 to derive therefrom time-divided key code signals, i.e. a time-divided periodic signal ① and a serial data signal ② respectively shown in FIGS. 4*a* and 4*b*. By a retriggerable time setting circuit 3 a certain time interval is set for distinguishing between, for example, a chord time and a base tone in the serial data signal ② which are derived from the two voicing blocks. The output from the retriggerable time setting circuit 3 has such a waveform 3 as shown in FIG. 4*c* which falls upon the rise of the chord tone in the serial data signal ② of FIG. 4*b* , rises after the duration of chord data and a chord and base tone discriminating time $T_0$, falls again upon the rise of the next base tone and is finally reset by the periodic signal to rise. This output ③ is applied to a clock (CL) terminal of a D flip-flop 4 supplied at its D terminal with a high level and the periodic signal ① from the key code generator 2 is applied to a reset (R) terminal of the D flip-flop 4 to derive therefrom its Q and $\overline{Q}$ outputs, by which the chord and the base tone in the serial data signal ② can be separated from each other. As a consequence, only base data exists in the period of the $\overline{Q}$ output shown in FIG. 4*d*. Then, by providing the serial data signal ② from the key code generator 2 to the one input of each of the AND circuits 5 and 6 and the Q and $\overline{Q}$ outputs from the D flip-flop 4 to their other inputs, there can be obtained the chord tone from the AND circuit 5 and the base tone from the AND circuit 6. The chord and the base tone thus obtained are supplied to decoders 7 and 9 respectively, latched at the timing of key depression from the key code generator 2 and converted to analog signals, which are applied to voicing circuits 8 and 10 respectively, thereafter being combined and provided to a sound system composed of an amplifier 11 and a speaker 12.

The D flip-flop 4 used in FIG. 2 may be replaced with an RS flip-flop or shift register.

FIG. 3A illustrates the circuit arrangement in the case of employing an RS flip-flop 4', and in FIG. 3A the input numbers ① to ④ are the same as those in FIG. 2. A differentiation circuit is provided at the input part of a set terminal of the RS flip-flop 4' and performs a differentiation upon the rise of the output ③ from the retriggerable time setting circuit 3 to set the RS flip-flop 4'. The reason for the provision of the differentiation circuit is that in the absence of such a differentiation circuit, when the inputs to the reset (R) and set (S) terminals of the RS flip-flop 4' are both "1", its Q and $\overline{Q}$ outputs both become "1", making it impossible to distinguish between the chord and the base tone. The operation of the RS flip-flop 4' is substantially identical with that of the D flip-flop 4 employed in FIG. 2. FIG. 3B shows the circuit arrangement in the case of a shift register 4''. In this case, the Q and $\overline{Q}$ outputs from the D flip-flop 4 are substituted with a first stage output $Q_0$ of the shift register 4'' and its inverted signal. The operation of the shift register 4'' is also substantially the same as that of the D flip-flop 4 utilized in FIG. 2.

Figure 5:
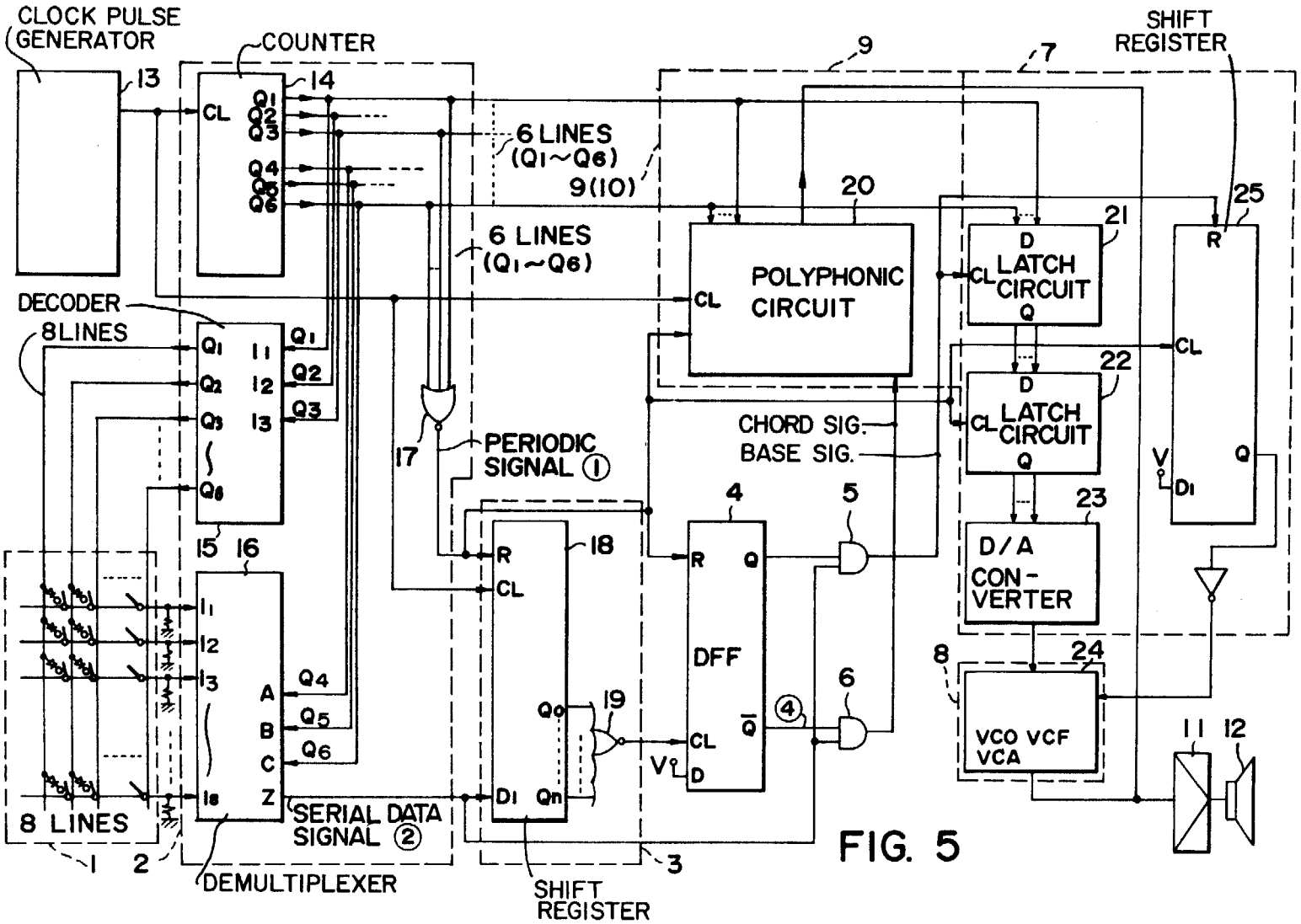
FIG. 5 illustrates a specific circuit arrangement of the embodiment shown in FIG. 2.

FIG. 5 illustrates a specific circuit arrangement of the embodiment of FIG. 2. In FIG. 5, the key switch 1 is constituted by a diode matrix composed of 8×8 diodes and detects key depression of the single 61-key manual keyboard. The key code generator 2 counts clock pulses (CL) from a clock pulse generator 13 by a 64-step counter 14 and provides its timing outputs ($Q_1$ to $Q_3$) via a decoder 15 to 8-column lines of the diode matrix of the key switch 1. Signals of its 8-row lines are supplied as inputs ($I_1$ to $I_8$) to a demultiplexer 16 to derive at its output terminal Z the serial data signal ② by timing signals $Q_4$ to $Q_6$ from the counter 14. Upon depression of a desired key of one of the rows of the diode matrix, a high-level voltage occurs in the corresponding one of the 8-row lines, and in this case, if the key switch 1 is arranged so that the chord tone is given priority over the base tone such a serial data signal ② as shown in FIG. 4b is derived from the demultiplexer 16. In the case of a desired number of keys being depressed, if the chord tone is given priority over the base tone, the demultiplexer 16 yields the serial data signal ② in which a depressed key signal from the chord tone voicing block procedes a depressed key signal from the base tone voicing block whose frequency range is lower than that of the chord tone voicing block. A NOR circuit 17 to which the output ($Q_1$ to $Q_6$) from the counter 14 is branched and applied provides the periodic signal ①.

The retriggerable time setting circuit 3 comprises a serial-parallel shift register 18 and a NOR circuit 19. The serial-parallel shift register 18 is driven by the clock pulses (CL) and supplied at its terminal D1 with the serial data signal ② and at its reset (R) terminal with the periodic signal ①, applying its outputs from stages $Q_0$ to $Q_n$ to the NOR circuit 19. The output from the NOR circuit 19 remains high-level if the input to the terminal D1 is high-level, that is, if no key is depressed, and the output drops its lower level when one key is depressed; furthermore, the output returns to the high level after the output from the serial-parallel shift register 18 shifts from the output stage $Q_0$ to $Q_n$. In the case of FIG. 4b, since three keys have been depressed in the chord tone voicing block, the output from the NOR circuit 19 varies from the high level to the low level upon occurrence of the chord tone (1) and assumes the high level a certain period of time $T_0$ after the chord tone (3). This certain time interval, i.e. the interval between the chord tone voicing block and the base tone voicing block is usually one to two octaves, and consequently a desired interval can be set within this range by selecting the number of output stages of the serial-parallel shift register 18 arbitrarily. Since the keys of the key switch 1 are each scanned by one clock pulse, serial-parallel shift register 18 provides outputs from twelve stages $Q_0$ to $Q_{11}$ in the case of the interval being one octave and outputs from twenty-four stages $Q_0$ to $Q_{23}$ in the case of the interval being two octaves. It is the subject matter of the present invention that makes the above certain time interval to make a distinction between the two tones.

The D flip-flop 4 is held high in level at its terminal D and supplied, as its clock pulses (CL), with the output from the NOR circuit 19 and reset by the periodic signal ①. Since the output from the NOR circuit 19 assumes the waveforms shown in FIG. 4c, the D flip-flop 4 yields its $\overline{Q}$ output signal ④ of such a waveform as shown in FIG. 4d which falls in synchronism with the rise of the output from the NOR circuit 19 and is reset again by the rise of the periodic signal ① to rise.

The AND gate 6 preferentially latches a desired number of depressed keys as chord data, which is applied to a polyphonic circuit 20 for conversion into analog form. The AND gate 5 outputs base data, which is latched in a latch circuit 21 by a timing signal, and in the next period the latched data is stored in a latch circuit 22, thereafter being converted by a D/A converter 23 into an analog signal.

A shift register 25 detects a key release in the base tone voicing block. That is, upon depression of a key in the base tone voicing block, an envelope gate included in each of a voltage-controlled oscillator, a voltage-controlled filter and a voltage-controlled amplifier constituting a circuit 24 is opened to create a base tone of a frequency by a pitch determining voltage signal corresponding to the depressed key, from the D/A converter 23. The base tone is mixed with the chord tone from the polyphonic circuit 20 into a composite signal, which is provided to the sound system composed of the amplifier 11 and the speaker 12.

Figure 6:
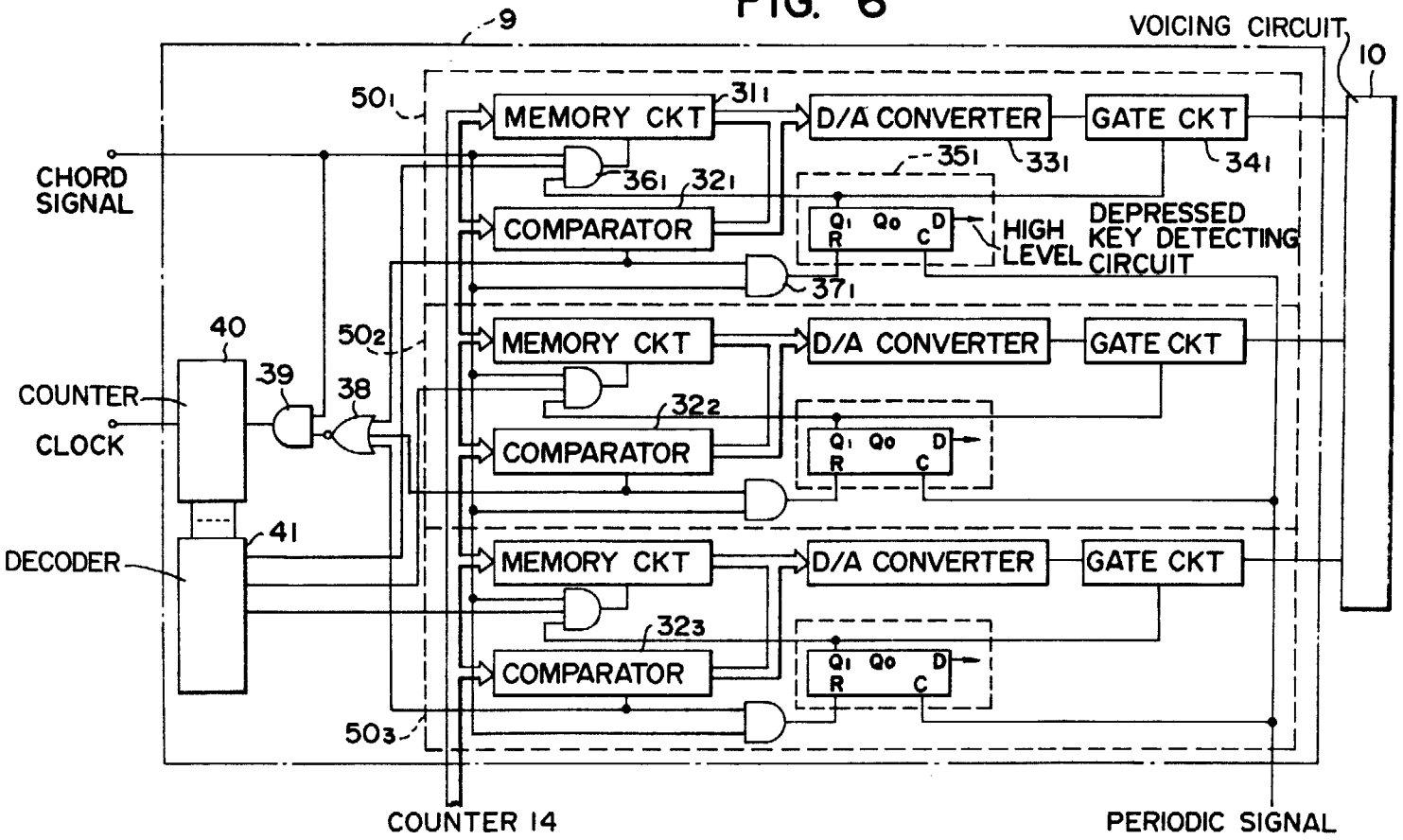
FIG. 6 is a circuit diagram showing a decoder 9 used in the circuit of FIG. 5.

FIG. 6 illustrates in detail an example of the decoder 9 employed in FIG. 5. This circuit is designed to preferentially reproduce a predetermined number of notes in response to depression of a plurality of desired keys, using a digital circuit.

FIG. 6 shows only those parts in FIG. 5 which relate to the decoder 9. The decoder will be described in brief with reference to FIG. 6.

There are provided circuits $50_1$, $50_2$ and $50_3$ surrounded by the broken lines, corresponding to three desired tones. Since the circuits $50_1$ to $50_3$ of the same construction are interconnected in parallel, their internal construction will be described in respect of the circuit $50_1$.

The time-divided signal from the aforesaid counter 14 is applied to a memory circuit $31_1$ in the circuit $50_1$ and stored by a read signal from an AND circuit $36_1$ supplied with the chord signal ②. The output read out from the memory circuit $31_1$ is converted by a D/A converter $33_1$ to an analog signal, which is provided via a gate circuit $34_1$ to the voicing circuit 10. A comparator $32_1$ compares the signal applied from the counter 14 to the memory circuit $31_1$ and the output signal therefrom and yields a coincidence signal in the case of coincidence between the both signals. The coincidence signal is provided to an AND circuit $37_1$, wherein it is AND'ed with the chord signal ②, and the AND'ed output is applied to a depressed key detecting circuit $35_1$ to reset it. By the periodic signal ① which is applied to the depressed key detecting circuit $35_1$ immediately following the resetting, a $Q_1$ output of the circuit $35_1$ is made low-level to open the gate circuit $34_1$ to pass on the analog signal from the D/A converter $33_1$ to the voicing circuit 10. By the dropping of the $Q_1$ output, the read signal from the AND circuit 36 is turned OFF. At the same time, the coincidence signal from the comparator $32_1$ is also applied to a NOR circuit 38 together with coincidence signals from comparators $32_2$ and $32_2$ of the other circuits $50_2$ and $50_3$, and the output from the NOR circuit 38 is provided via an AND circuit 39 to a counter 40 together with the chord signal ②. The counter 40 operates while the output from the AND circuit 39 is high-level and stops while the output is low-level. The output from the counter 40 is applied to a decoder 41 to provide high-level outputs on three output lines of the decoder 41 one after another. These output signals are each supplied to the AND circuit 36 to serve as the read signal for the memory circuit 31. Accordingly, when the AND circuit 39 yields a high-level output, that is, in the case where the chord signal is produced and the comparator 32 provides a low-level signal which does not coincide with the signal stored in the memory circuit 31 of each of the circuits $50_1$ to $50_3$, the counter 40 operates to shift a high-level one of the three outputs of the decoder 41, hunting for that one of the circuits $50_1$ to $50_3$ which is capable of storing the time-divided signal from the counter 14. In this way, a plurality of tones, especially more than two tones are specified and are preferentially reproduced; namely, there is provided the function that even if keys more than the specified tones are depressed, only the preferential tones are reproduced.

Figure 7:
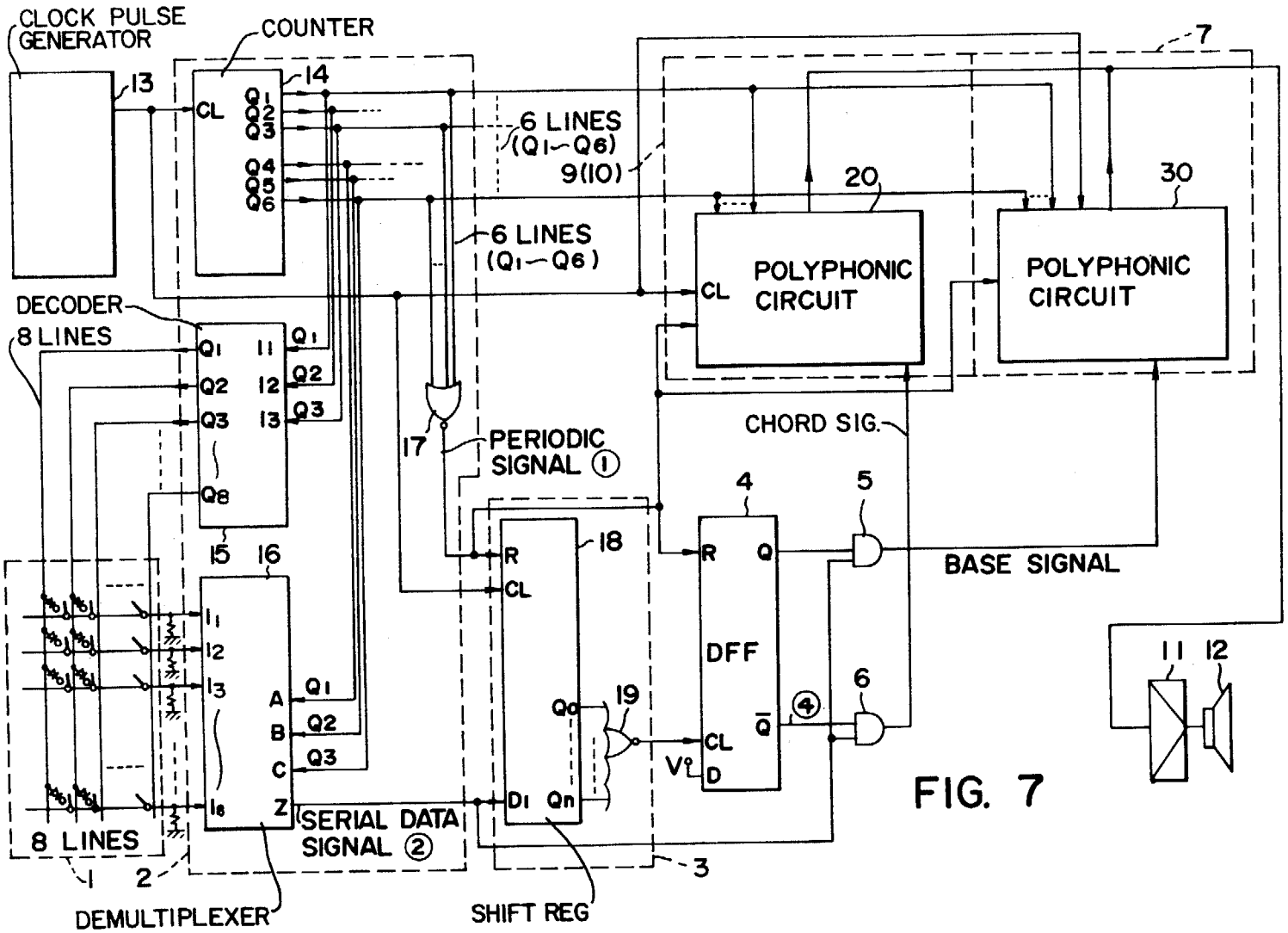
FIG. 7 is a block diagram illustrating another embodiment of the present invention.

FIG. 7 illustrates the circuit arrangement of another embodiment of the present invention. In the circuits of FIGS. 2 and 5, a combination of a single tone such as the base tone with a multiple tone such as the chord, solo or like tone is produced by the two voicing blocks, but use can also be made of a combination of multiple tones. In the embodiment of FIG. 7, the circuits 21 and 25 used in FIG. 5 are replaced with a decoder 7 constituted by a polyphonic circuit 30 similar to that 20. The operations of this embodiment are the same as those described previously in connection with FIGS. 4*a* to *d* except in that the base data of the single tone is substituted with data of a multiple tone.

With such an arrangement of FIG. 7, it is possible to generate the solo tone from the first voicing block and the chord and the base tone from the second voicing block, or the chord tone from the first voicing block and the solo and the base tone from the second voicing block. This allows the player to give free expressions to his thoughts by a combination of tones different from a combination of tones by tone tablets which are prearranged in keyboards in conventional electronic musical instruments.

Figure 8A:
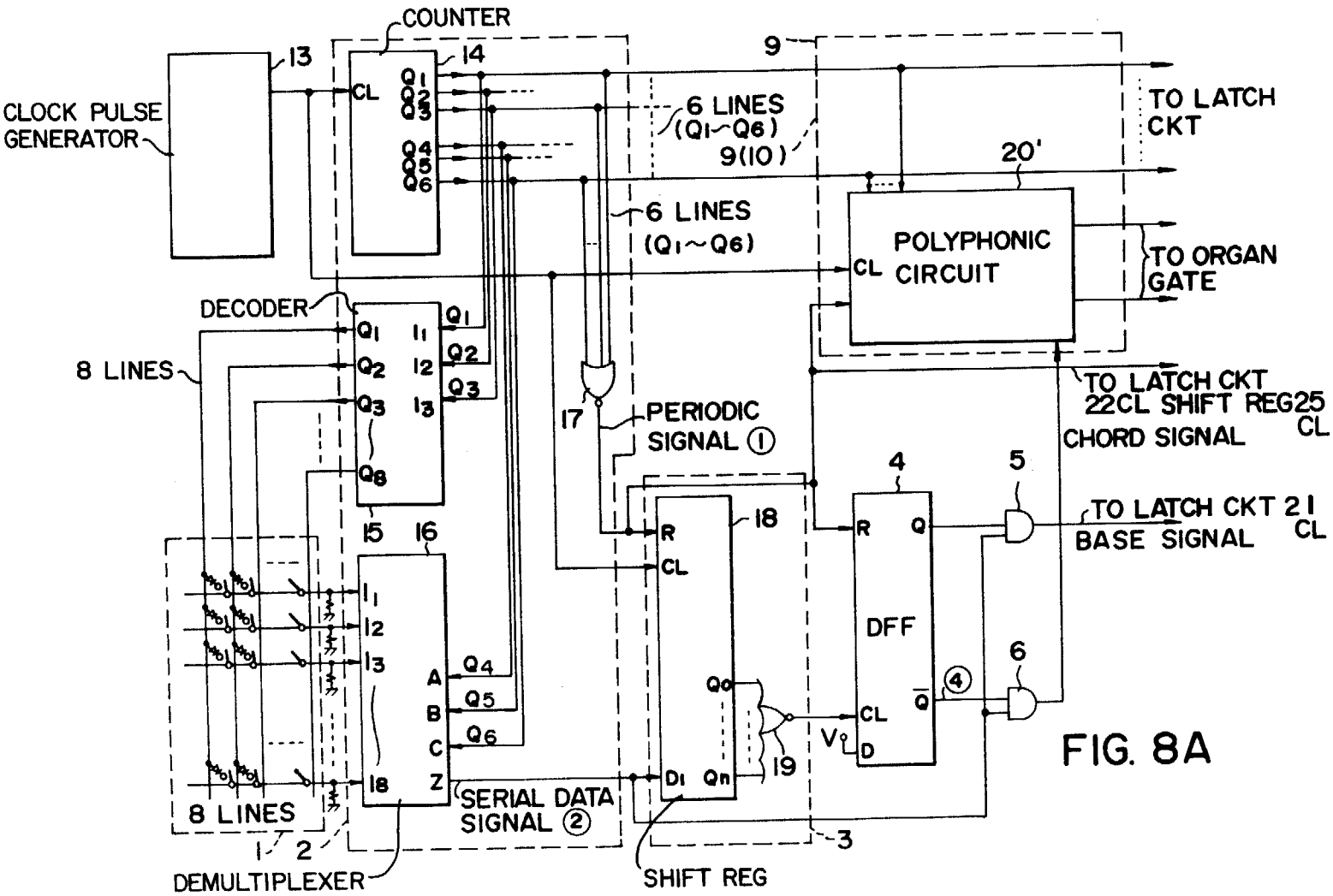
FIGS. 8A and 8B are block diagram illustrating still another embodiment of the present invention.
Figure 8B:
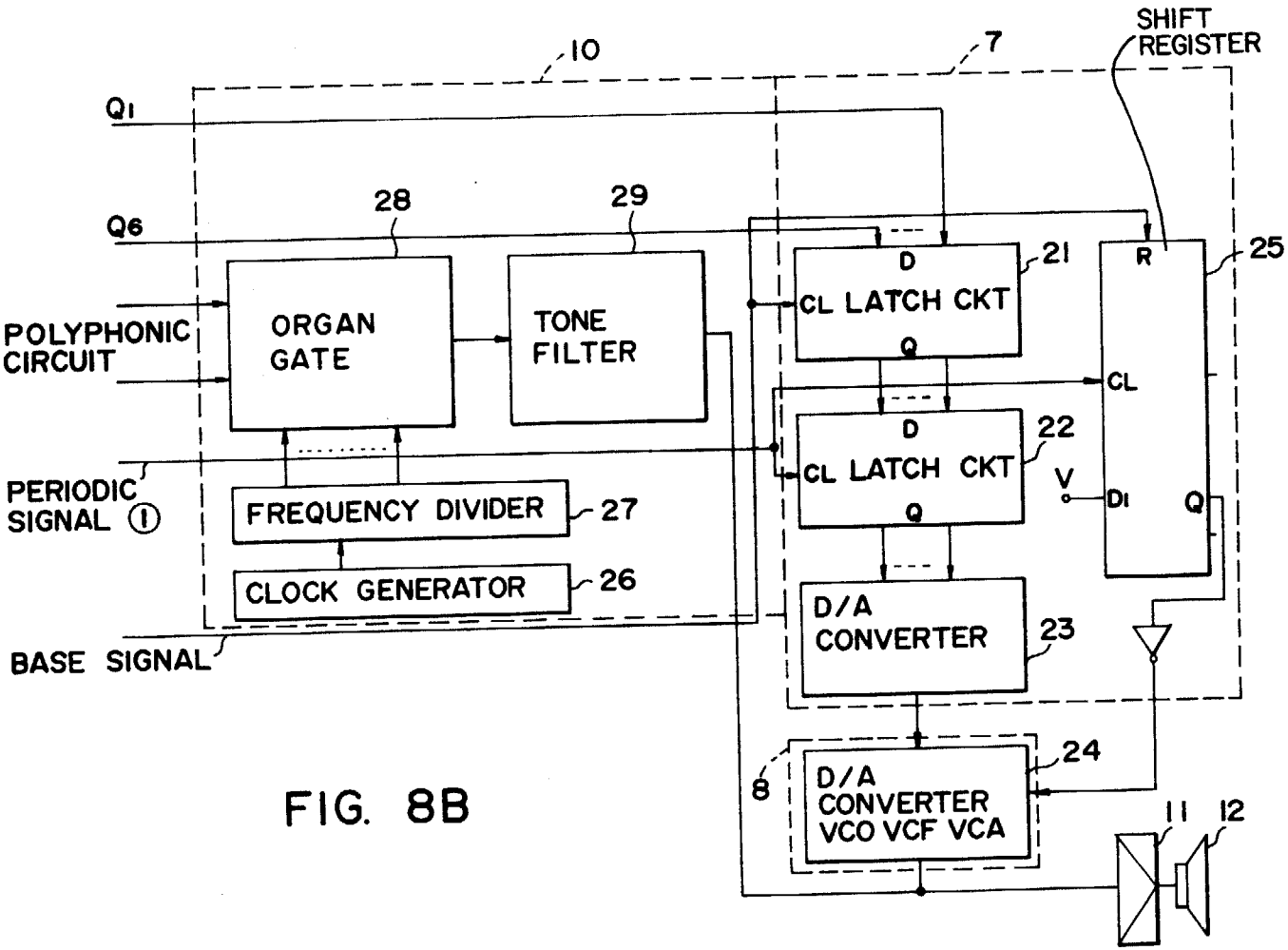

FIGS. 8A and 8B illustrate the arrangement of still another embodiment of the present invention. In this embodiment, the two voicing blocks are a combination of a single tone with a multiple tone as is the case with the embodiments of FIGS. 2 and 5, but an ordinary electronic organ circuit is employed as the voicing circuit 10. Therefore, as a polyphonic circuit 20', the circuit of the construction shown in FIG. 6 cannot be utilized and use is made of a circuit of the type that decodes the 6-bit output from the counter 14 to obtain outputs corresponding to sixty-one keys. As shown in the voicing circuit 10 surrounding by the broken line in FIG. 8B, clock pulses from a clock generator 26 are frequency divided by a frequency divider 27, whose output is applied to an organ gate 28, and a chord tone or solo tone from the polyhonic circuit 20', corresponding to the key being depressed, is applied to a tone filter 29, thereafter being combined with the base tone.

Figure 9:
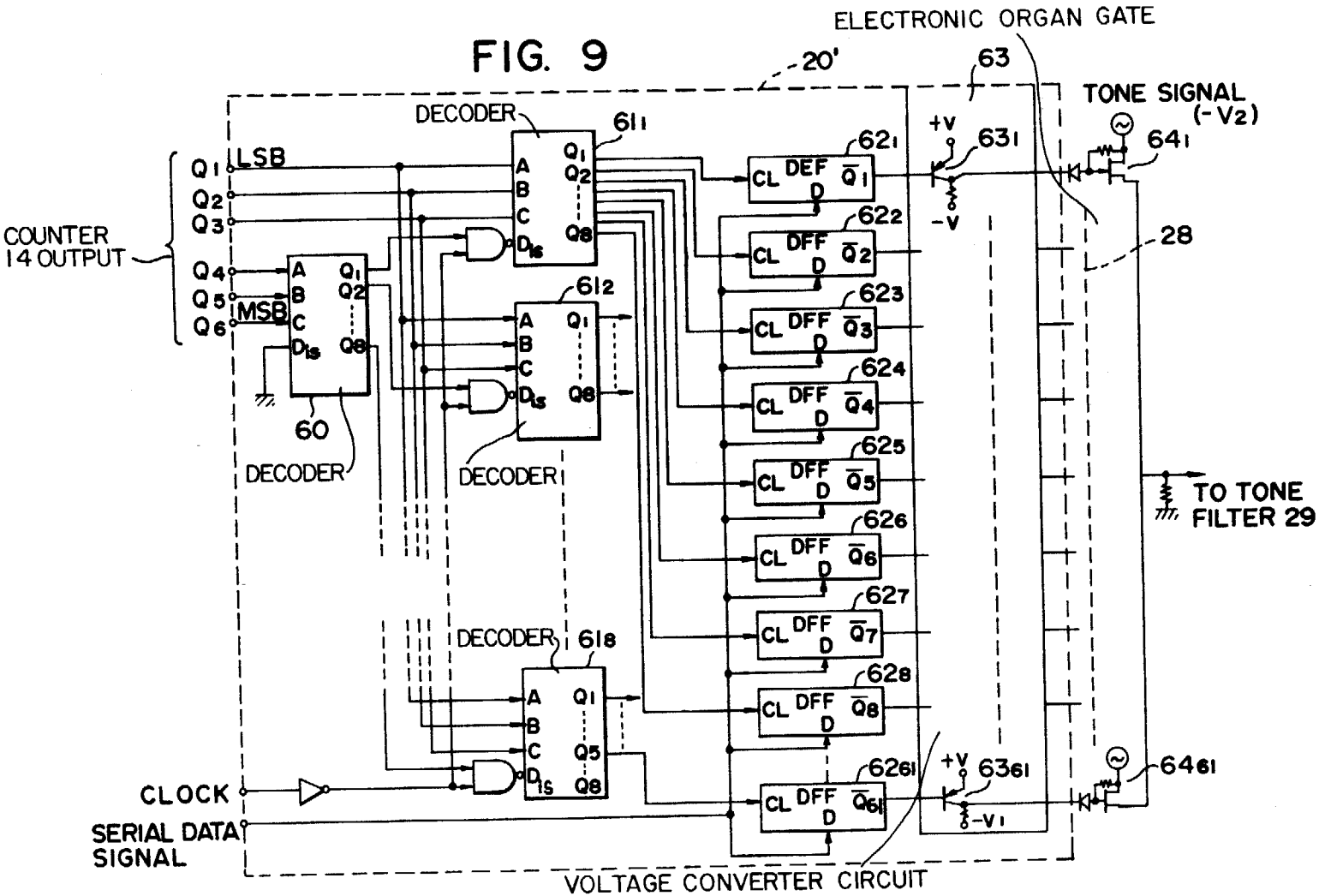
FIG. 9 shows in detail specific circuit arrangements of a polyphonic circuit 20' and an organ gate 28 employed in the embodiment of FIGS. 8A and 8B.

FIG. 9 illustrates in detail examples of the circuit arrangements of the polyphonic circuit 20' and the organ gate 28 used in the embodiment of FIG. 8B. In FIG. 9, three bits of the 6-bit output from the counter 14 are applied in parallel to eight decoders $61_1$ to $61_8$, and the other remaining bits are supplied to a decoder 60, whose eight outputs are respectively provided to terminals $D_1$ of the eight decoders $61_1$ to $61_8$ in synchronism with the clock pulse. Then, eight outputs are derived from each of the decoders $61_1$ to $61_7$ and five outputs are derived from the decoder $61_8$ alone; thus, sixty-one outputs in all are obtained. These outputs are respectively applied to terminals CL of D flip-flops $62_1$ to $62_{61}$ and the serial data signal is supplied to a terminal D of each of the D flip-flops $62_1$ to $62_{61}$ to derive therefrom its $\overline{Q}$ outputs, which is provided to a voltage converter 63 composed of PNP type transistors $63_1$ to $63_{61}$, wherein gate control voltages +V are converted into voltages −V. Since the electronic organ gate 28 is supplied with a negative voltage input, the positive voltage +V and the negative voltage −V are respectively applied to the emitter and the collector of each of the PNP type transistors $63_1$ to $63_{61}$ to derive from the collector a predetermined voltage for input to the electronic organ gate 28.

The electronic organ gate 28 comprises field effect transistors $64_1$ to $64_{61}$. The voltage outputs +V from the voltage converter 63 (the $\overline{Q}$ output being 0 V) are each provided via a diode to the gate of one of the field effect transistors and a tone signal $V_2$ from the frequency divider 27 is applied to the source of each field effect transistor to derive from its drain a composite output, which is supplied to the tone filter 29.

The voicing circuit 10 described above is advantageous in that an ordinary, inexpensive electronic organ circuit can be used.

As has been described in the foregoing, according to the present invention, there are provided in a single manual keyboard two voicing blocks which have a certain interval therebetween and at least one of which generates a multiple tone corresponding to a key being depressed, and there are provided a circuit for producing, from a time-divided signal by key depression, a constant time interval for distinguishing between tones from the two voicing blocks to separate them from each other and a circuit for generating a monophonic or polyphonic tone signal from each of the separated time-divided signals.

With such an arrangement, it is possible to perform, with a single manual keyboard alone, playing similar to that using a plurality of keyboards. In other words, it is possible to play arbitrarily using various combinations of monophonic and polyphonic tones, for example, by selecting a polyphonic tone in the chord part and a monophonic tone in the base part or combining it with the solo part. On top of that, the electronic musical instrument of the present invention can be made less bulky, less heavier and less expensive than conventional electronic musical instruments. Further, it is also possible to use the electronic musical instrument of the present invention in combination with a synthesizer; in this case, the synthesizer is used as the solo part and the base and the chord part are formed according to the present invention.

It will be apparent that many modifications and variations may be effected without departing from the scope of the novel concepts of this invention.

What is claimed is:

1. An electronic musical instrument comprising:

a single manual keyboard having keys;

said keyboard being provided with two voicing blocks, one of said voicing blocks producing, in response to key depression, at least one of a melody tone, an accompaniment tone, or a base tone, with the other of said blocks producing at least one of the remaining of said tones, said voicing blocks having a spatial interval of keys of the keyboard therebetween;

means for producing time-divided signals by depression of a key;

first circuit means responsive to said time-divided signals for producing a certain time interval for distinguishing between tones produced by said voicing blocks and for thereby separating in time the tones produced, and a second circuit means for producing monophonic and polyphonic sounds from the tones separated by said first circuit means.

2. An electronic musical instrument according to claim 1, wherein said first circuit means comprises a retriggerable time setting circuit for producing the certain time interval, a flip-flop switched in accordance with the separated tones from the first circuit means, and a gate circuit for assigning to the two voicing blocks the time-divided signals corresponding to the keys being depressed.

3. An electronic musical instrument according to claim 1, wherein said first circuit means comprises a retriggerable time setting circuit for producing the certain time interval, a shift register switched in accordance with the separated tones from the first circuit means, and a gate circuit for assigning to the two voicing blocks time-divided signals corresponding to the keys being depressed.

4. An electronic musical instrument according to claim 1, wherein said second circuit means comprises a decoder means for preferentially decoding from one of said voicing blocks, and a voicing circuit.

5. An electronic musical instrument according to claim 1, wherein said second circuit means comprises a decoder for decoding the tone signals, and a voicing circuit for producing the frequency of the sound.

* * * * *